US007146314B2

(12) United States Patent
Wang

(10) Patent No.: US 7,146,314 B2
(45) Date of Patent: Dec. 5, 2006

(54) DYNAMIC ADJUSTMENT OF NOISE SEPARATION IN DATA HANDLING, PARTICULARLY VOICE ACTIVATION

(75) Inventor: Yunbiao Wang, Fremont, CA (US)

(73) Assignee: Renesas Technology Corporation, Tokyo (JP)

( * ) Notice: Subject to any disclaimer, the term of this patent is extended or adjusted under 35 U.S.C. 154(b) by 731 days.

(21) Appl. No.: 10/027,934

(22) Filed: Dec. 20, 2001

(65) Prior Publication Data

US 2003/0120487 A1 Jun. 26, 2003

(51) Int. Cl.
*G10L 21/02* (2006.01)

(52) U.S. Cl. ..... 704/233; 704/214; 704/226

(58) Field of Classification Search ..... 704/233, 704/214, 226

See application file for complete search history.

(56) References Cited

U.S. PATENT DOCUMENTS

| | | | | |
|---|---|---|---|---|
| 4,277,645 | A * | 7/1981 | May, Jr. | 704/233 |
| 4,357,491 | A | 11/1982 | Daaboul | |
| 4,410,763 | A | 10/1983 | Strawczynski et al. | |
| 4,700,392 | A | 10/1987 | Kato et al. | |
| 4,712,235 | A | 12/1987 | Jones | |
| 4,829,578 | A * | 5/1989 | Roberts | 704/233 |
| 5,152,007 | A | 9/1992 | Uribe | |
| 5,276,765 | A | 1/1994 | Freeman et al. | |
| 5,907,823 | A | 5/1999 | Sjoberg et al. | |
| 5,991,718 | A | 11/1999 | Malah | |
| 6,154,721 | A | 11/2000 | Sonnic | |
| 6,275,794 | B1 | 8/2001 | Benyassine et al. | |
| 6,381,568 | B1 * | 4/2002 | Supplee et al. | 704/210 |
| 6,381,570 | B1 * | 4/2002 | Li et al. | 704/233 |
| 2002/0021798 | A1 * | 2/2002 | Terada et al. | 379/347 |
| 2002/0041678 | A1 * | 4/2002 | Basburg-Ertem et al. | 379/406.01 |
| 2004/0125962 | A1 * | 7/2004 | Christoph | 381/59 |

* cited by examiner

*Primary Examiner*—V. Paul Harper
(74) *Attorney, Agent, or Firm*—Squire, Sanders & Dempsey L.L.P.

(57) ABSTRACT

Data handling dynamically responds to changing noise power conditions to separate valid data from noise. A reference power level acts as a threshold between dynamically assumed noise and valid data, and dynamically refers to the reference power level changing adaptively with the background noise. The introduction of dynamic noise control in VOX (Voice Activated Transmission) improves a VOX device operation in a noisy environment, even when the background noise profiles are changing. Processing is on a frame by frame basis for successive frames. The threshold is adaptively changed when a comparison of frame signal power to the threshold indicates speech or the absence of speech in the compared frame repeatedly and continuously for a period of time involving plural successive frames having no valid speech or noise above the threshold to correspondingly reduce or increase the threshold by changing the threshold to a value that is a function of the input signal power.

5 Claims, 8 Drawing Sheets

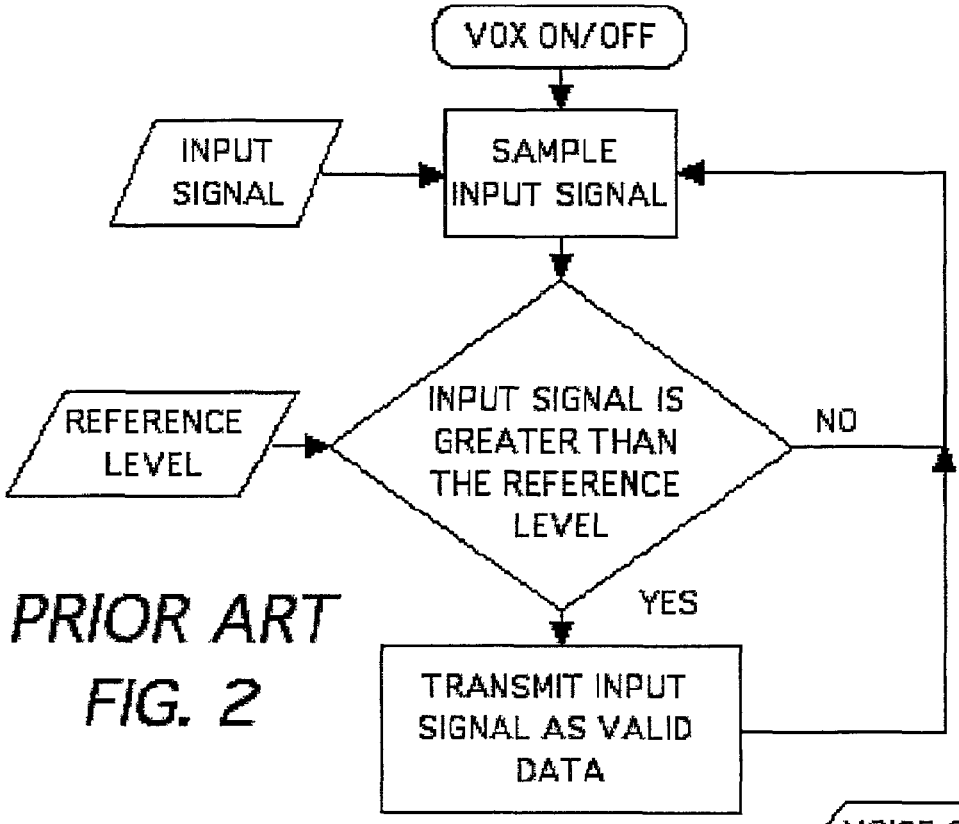
PRIOR ART FIG. 2
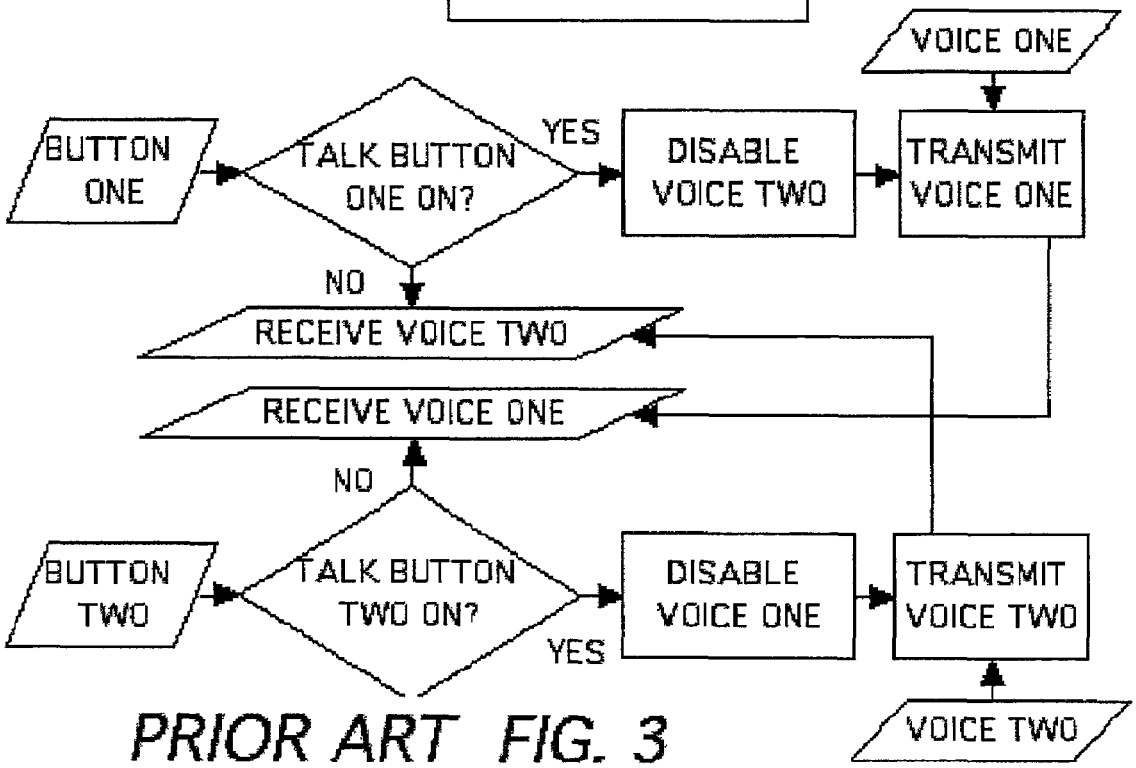
PRIOR ART FIG. 3

DYNAMIC ADJUSTMENT OF NOISE SEPARATION IN DATA HANDLING, PARTICULARLY VOICE ACTIVATION

BACKGROUND OF THE INVENTION

This invention relates to data signal analysis generally, particularly data signal activation, more particularly to voice activation or voice operated control (sometimes generally referred to as VOX), and most preferably to voice activation transmission, i.e. VOX (Voice Operated eXchange).

VOX, as generally shown in FIG. 2, is widely used in hands-free voice signal communications, such as cellular phones and walkie-talkies. VOX desirably transmits a speech signal only when the user starts talking, when the input signal is greater than a reference level. When the user stops talking and therefore the input signal is not greater than the reference level, VOX stops transmitting the signal. The accurate detection of the existence of a speech signal is critical to make a VOX device work properly. In other words, it is very important for a VOX device to correctly distinguish the speech signal from a noise signal.

To allow both parties to talk to each other without VOX, PTT (Push To Talk, generally shown in FIG. 3), provides a half duplex communication. However, PTT requires users to press a button every time one starts to talk, therefore it is not hands-free.

To provide hands-free communication, the devices must be able to automatically decide when to transmit and when not to transmit. This is the function of VOX, which therefore needs to distinguish between speech and noise. The simple method of FIG. 2 distinguishes speech and noise by comparing the signal power with the fixed preset reference level. When the signal power is larger than the reference level, VOX decides that the signal is speech and VOX transmits the signal. If the signal power is less than the reference level, VOX decides that the signal is at most noise and will not transmit the signal.

The prior art has many detectors of noise that sample and use amplitude of the samplings in making noise determinations.

U.S. Pat. No. 5,991,718 discloses a noise threshold adaptation for voice activity detection. Power of a plurality of segments in a segment is determined, but power values are buffered and combined with complex and intensive calculations. A power stationarity test is disclosed that buffers segment (e.g. 256 samplings per segment) power values (e.g. 30 values buffered) and then for each segment the ratio between the largest and smallest data values present in the buffer are compared to a given threshold; as mentioned, the stationarity test is not satisfactory for various stated reasons and in addition it is complex in implementation and computational intensive. The solution is provided by the patent is even more complex, with smoothing of the values with a low pass filter and determining an inflection point of a lower envelope.

SUMMARY OF THE INVENTION

The present inventors have analyzed the above mentioned problems, identified and analyzed causes of the problems, and provided solutions to the problems. This analysis of the problems, the identification and analysis of the causes, and the provision of solutions are each parts of the present invention and will be set forth below.

This invention improves valid data detection by directly using power of one frame in a simple comparison to determine the truth of a condition, a relation, and changing the noise threshold when the relation is maintained over a period of time, preferably for plural frames. Thus, the invention is characterized by simplicity, low calculation complexity, low delay and low latency. The use of power is an improvement over the prior art use of amplitude for comparisons, in providing more stability. The frame based analysis with a codec in a VOX system is preferable to a sample based codec that requires buffering. Most preferably, the invention improves voice signal detection ability of VOX (Voice Activated Transmission), which is particularly applicable in a noisy environment.

Prior VOXs that use a fixed reference level to distinguish a speech portion of a signal from noise in the signal work well when the noise level is not changing significantly from the fixed reference level.

By the nature of some data, particularly speech, the valid signal changes rapidly and over a considerable range of amplitude as compared to noise that will change but at a much lower rate and which tends to maintain a fairly constant amplitude over a much longer period of time. Changing the threshold in response to changing amplitude produces inaccurate results, because at any one sampling time the amplitude of the valid signal is not reliably representative of the noise. With reference to FIG. 1, it is seen that if only one sample is taken at about sample 2.75 for a single spike of energy, the valid energy level of the signal is far above level A and the threshold would be changed upward unnecessarily if the only comparison was of energy or amplitude.

The inventor has determined that the use of signal power for the comparison is a considerable improvement over the use of only one sampling of amplitude or energy, in that it solves the above problem by addressing the cause of the problem; namely, the integration of plural amplitude or energy samplings of the signal over a substantial period of time to obtain power reliably prevents the above mentioned inaccuracy caused by the normal spikes of the valid signal. The period of time for the integration must be substantial enough to accurately reflect the presence of a valid signal by avoiding undue influence a spike in the valid data that may be present at the sampling instant, which plural samplings or integration period will therefore vary according to the type of data involved. This period is easily determined with these guidelines. While the use of power in comparisons involves greater consumption of system power and some small delay, the benefits are considerable in system accuracy.

However, further processing of the calculated power, for example, the use of a low pass filter on a plurality of power calculations to use a filtered value for comparison would greatly increase the delay in obtaining the comparisons and therefore delay the dynamic adjustment of the threshold level, and further the use of such further processing would increase the drain on and shorten the life of a battery in a portable device. A low pass filter, as a specific example, would effectively give different weight to the samplings and the more current samplings would have greater influence on the result, so that for speech or the like valid data, a single spike would have a large influence upon the filtered power values if the spike occurred in the last of the samplings used.

Therefore, the invention recognizes and analyzes a need for dynamic response to noisy conditions, to distinguish the data from noise accurately and with little overhead of power consumption and delay. Low complexity and fast response are obtained, with accuracy and low power consumption.

More particularly, the introduction of noise control in VOX allows a VOX device to work correctly in a noisy environment. The reference level changes adaptively with the background noise. This allows VOX to separate a speech portion of a speech signal from a noise portion of the speech signal, even when the background noise profiles are changing.

BRIEF DESCRIPTION OF THE DRAWING

The present invention is illustrated by way of example and not by way of limitation, in the figures of the accompanying drawings, in which like reference numerals refer to similar elements. Further objects, features and advantages of the present invention will become more clear from the following detailed description of a preferred embodiment and best mode of implementing the invention, as shown in the drawing, wherein:

FIG. 2 is a flowchart of the operation of VOX, in general, which is useful in setting forth the inventor's analysis of the prior art, which analysis is a part of the present invention;

FIG. 3 is a flowchart of the operation of push to talk devices (PTT), in general, which is useful in setting forth the inventor's analysis of the prior art, which analysis is a part of the present invention;

DETAILED DESCRIPTION OF THE PREFERRED EMBODIMENT

Figure 1:
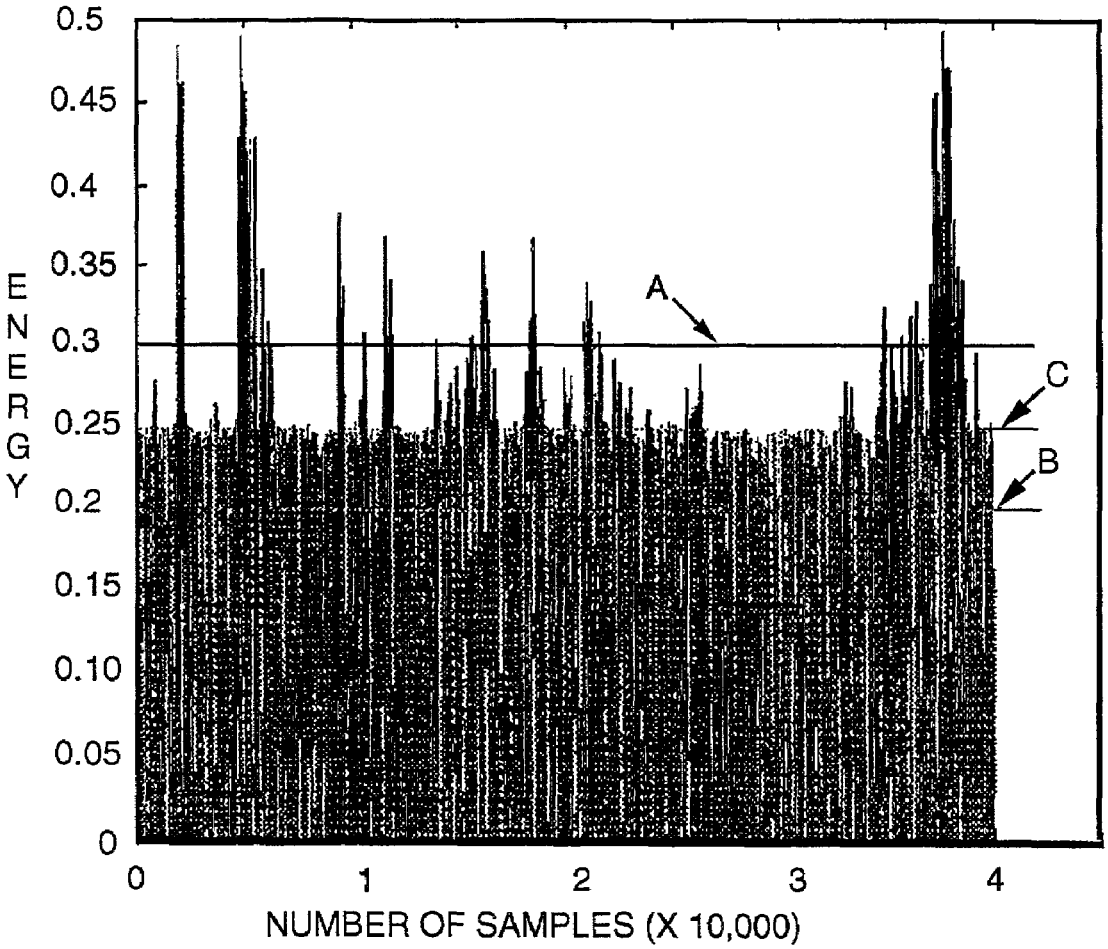
FIG. 1 is a an example plot of speech and noise energy distribution of a data signal.

A system, method, hardware, computer media and software for dynamic or real time consideration of changing noise level in separating an information or valid data signal from noise carried with it are described. In the following description, for the purposes of explanation, numerous specific details are set forth in order to provide a thorough understanding of the broader aspects of the present invention as well as to appreciate the advantages of the specific details themselves according to the more narrow aspects of the present invention. It is apparent, however, to one skilled in the art, that the broader aspects of the present invention may be practiced without these specific details or with an equivalent arrangement. Well-known structures and devices are shown in block diagram form in order to avoid unnecessarily obscuring the present invention with unnecessary details of well known technology.

Still other aspects, features, and advantages of the present invention are readily apparent from the following detailed description illustrating a particular implementation, including the best mode contemplated by the inventor. The present invention is also capable of other and different embodiments, and its several details can be modified in various respects, all without departing from the spirit and scope of the present invention. The drawing and description are illustrative, and restrictive.

FIG. 1 is a plot of a typical speech plus noise energy distribution of a signal, with added reference level and noise level indicators, which is useful in analyzing prior art VOX systems, which analysis is part of the present invention and is useful in disclosing the embodiment of the invention. The fixed reference level of the prior art should be just above the noise level, which is at C; this will detect the presence of a speech portion of the signal (above level C) accurately and eliminate the noise portion of the signal that is below level C. When the reference level is fixed too high at level A in the prior art, the lower portion of the speech signal, which is between levels A and C, will not be transmitted. When the reference level is set too low at level B in the prior art, the noise above than the reference level, which is between levels B and C, will be transmitted along with any speech present.

When the environment changes, the noise may extend below or above the level indicated at C in FIG. 1. The changes of the noise level will accordingly increase or reduce the difference between the reference level and the noise level. This change will affect the correctness of a detection of a speech portion of the signal in a noisy environment. When changes in the environment reduce the entire signal energy to level B or reduce only the noise to level B, any speech between level B and reference level C will be classified as noise and will not be transmitted. When changes in the environment increase the entire signal energy so that the noise raises to level A or increase only the noise to level A, some of the noise (between level A and reference level C) will be transmitted with the speech. Both of these scenarios of operation a VOX according to the prior art are undesirable.

The above analysis of a fixed reference level shows that with prior technology, it is difficult to separate speech and noise. The analysis would also apply to a system that inaccurately determined set the threshold reference level. Complicated algorithms designed to detect the presence of speech among noise have been used in applications such as acoustic echo cancelers. However, these algorithms are highly compute-intensive and therefore incur high implementation cost. An example of a complicated algorithm is one where a low pass filter would process a plurality of successive power values to obtain a single reference level. Such complication requires more computer battery power, more computation and thus delay time, greater sophistication and thus higher equipment cost, and can adversely affect accuracy as in the filter example that weights the more current values of power that may incur a spike.

This invention overcomes the aforementioned problems in data/noise detection, particularly in the preferred embodiment of VOX.

VOX is a voice controlled, half-duplex device (half-duplex transmits data in two directions, but not at the same time). When, for example the data source is a user talking, half-duplex VOX transmits the voice, otherwise, half-duplex VOX only receives the data signal from the other side. The present invention is also useful in full-duplex data transmission, which supports transmission simultaneously in two directions. By switching off the transmission when there is no data to transmit in either half-duplex or full duplex modes: battery power is saved in a system that uses batteries. Generally transmission takes more power than merely monitoring for and receiving incoming data. There is a saving of transmission power, also useful in energy saving non-battery devices. Bandwidth of transmission is saved, particularly in shared transmission line systems, such as over the internet or satellite transmission. However, this saving should not be at the expense of accuracy and should not be canceled by increased power consumption and cost due to complexity of a dynamic noise adjusting system.

Figure 4:
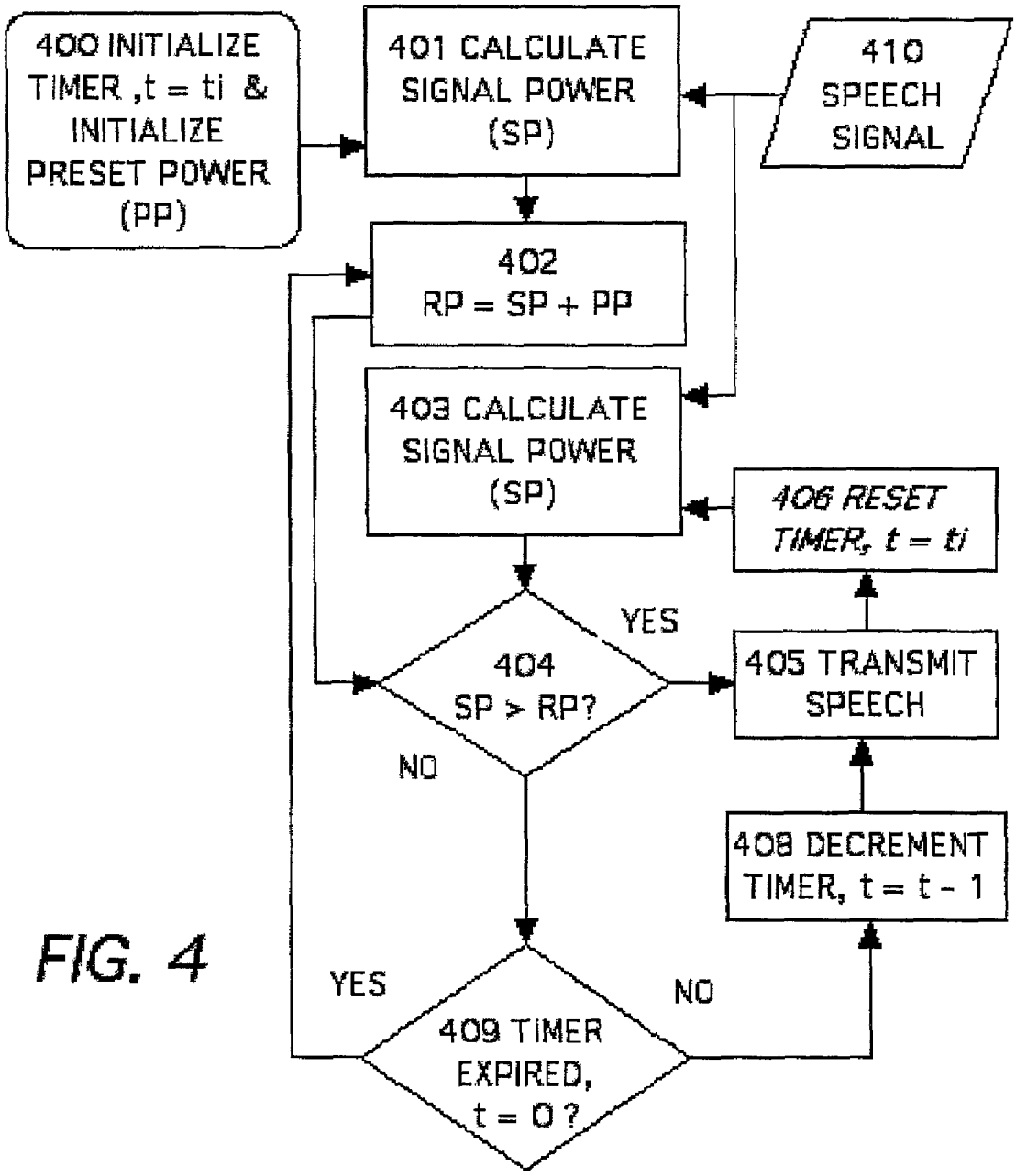
FIG. 4 is a flowchart of the operation of the embodiment of a VOX to dynamically adjust the reference level by dynamically estimating noise power.
Figure 5:
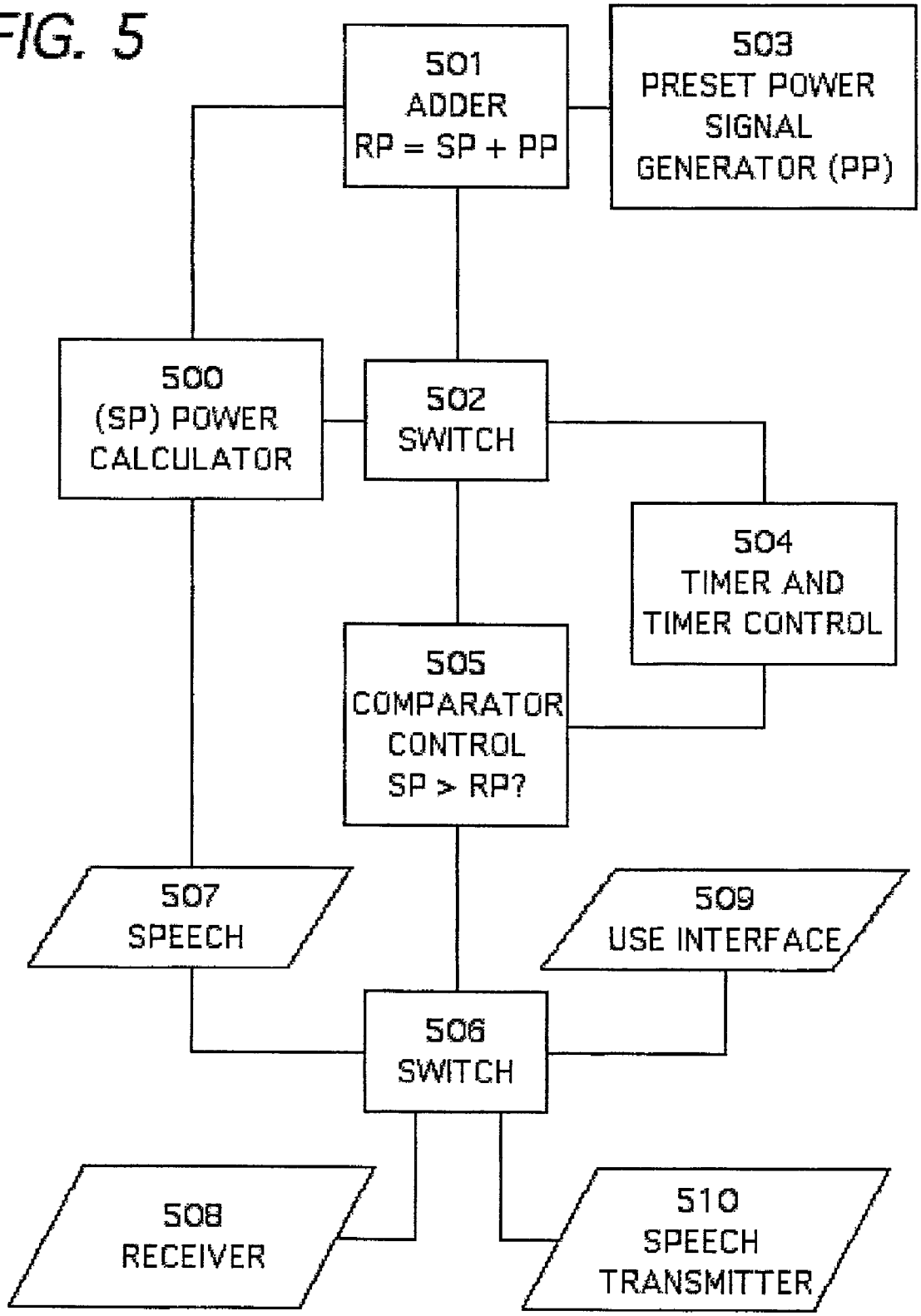
FIG. 5 shows the embodiment hardware apparatus for VOX using the hardware of FIG. 5 and/or software further disclosed with respect to FIG. 4, whose operation is further described in FIG. 4.
Figure 6:
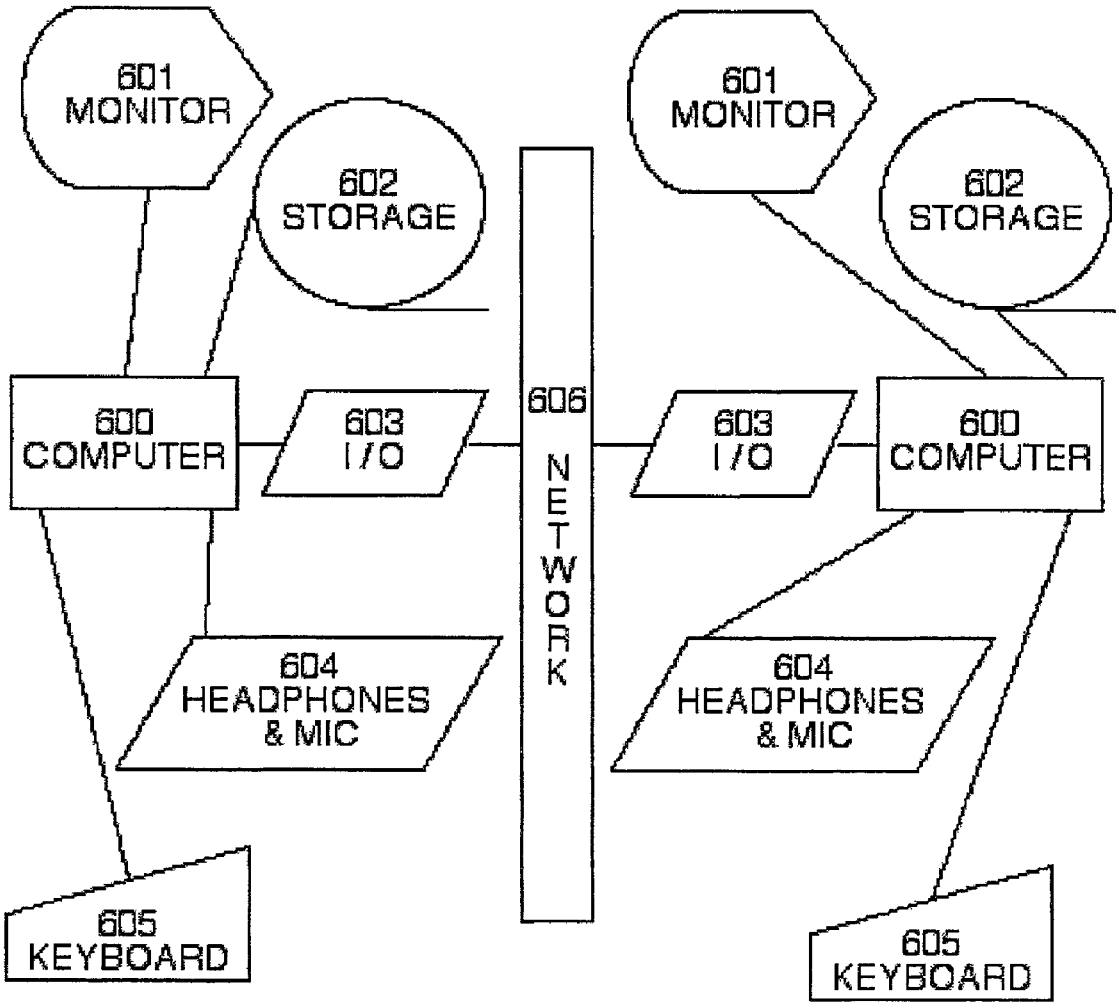
FIG. 6 shows the embodiment system for VOX.

FIG. 4 is a flowchart showing operation of the embodiment device of FIG. 5 and the function of the software in the computer system embodiment of FIG. 6. The following is a description of the steps in the flowchart of FIG. 4 (with reference to structure of FIG. 5), particularly for the preferred half-duplex VOX.

Step 400, initializes a time period t to an initial value ti for a timer (provided by the timer control 504) and initializes the value of the preset power (PP) (provided by the preset power signal generator 503). The timer initial value used may be fixed at manufacture, fixed by a technician at any time, or selected/set by a user. The actual timing may be a decrementing timer or an incrementing timer based upon a clock signal, machine cycles, invocations of a recursive function or iterations of a loop function or the like. The PP value used may be fixed at manufacture, fixed by a technician at any time, determined as the power of the input signal or a function thereof at the time of power on when it is assumed speech is not present, or selected/set by a user. It may be an actual power value or a function thereof, or a value representative thereof, but corresponding to the type of signal calculated in steps 401 and 404.

Step 401 inputs the speech signal 410 (from speech input 507 ) or a signal dependent thereon, which may or may not contain variable noise. By using the current speech signal 410, step 401 calculates (with power calculator 500) the signal power (SP) as an integration of the signal energy level over a short period of time. SP is an integration of signal energy over a period of time that in FIG. 1 would involve would involve a plurality of samplings with processing being digital according to the preferred embodiment. In FIG. 1, energy of the speech signal is plotted versus elapsed time for a sample speech signal. This period of time over which the speech signal, which may contain noise, is integrated to obtain power is not the same as the period of the timer initialized in step 400 or as reset in step 406, as will become more apparent. This period of integration distinguishes the present invention from merely taking a sample of the speech signal, which would involve only amplitude or energy. As mentioned, this integration period is long enough to not be overly affected by a single sample and short enough for rapid response, that is the period of integration is substantial, with the actual value being easily determined from these guidelines in a particular application by one having ordinary skill. Steps 401 and 400 may be reversed in sequence. Integration is the the embodiment implementation of obtaining power, and numerous equivalent implementations for obtaining the power of a signal are available for use in the present invention, all according to ordinary skill.

Step 402 combines the preset power PP, or a power signal derived therefrom and that is directly representative of power over the integration period, with the signal power SP, or a signal dependent thereon that is directly representative of power over the integration period. The embodiment simply adds the values of SP and PP, for example by simple addition or a weighted addition (with the adder 501) and provides a result as a reference power signal RP, or a signal dependent thereon that is directly representative of power over the integration period. This combining may take various forms, however the preferred simple addition is most advantageous in obtaining low complexity, response speed, and low cost.

Step 404 compares the signal power SP with the reference power RP (in comparator control 505). When SP is greater than RP, processing proceeds to step 405, and when SP is not greater than RP, processing proceeds to step 409. When the speech signal power SP is higher than the reference level RP, step 404 chooses the transmission of speech (with switch 506 connecting the speech input 507 with the speech transmitter 510), whereby only the speech portion of the speech signal 410 is transmitted in step 405 (using the speech transmitter 510). Otherwise, when the speech signal power is lower than or equal to the reference level RP, step 404 chooses to just receive by passing control to step 409 (switch 506, operated by the output of the comparator control 505, connects the receiver 508 to the use interface 509; thus switch 506 either connects 508 with 509 or connects 507 with 510 for the half-duplex operation; a modification of FIG. 4 and FIG. 5 for full-duplex operation is well within the purview of those having ordinary skill in these arts of the invention).

From step 405, operation proceeds to step 406, where the timer (timer and timer control 504) is reset to the initial value of step 400 or a different value t1. The order of steps 405 and 406 may be reversed. At the resetting of the timer, the timer control 504 operates the switch 502 to activate the power calculator 500 or merely enable its output.

Next after step 406, step 403 inputs the speech signal 410 (from speech input 507) or a signal dependent thereon, which may or may not contain variable noise. By using the current speech signal 410, step 403 calculates (with power calculator 500) the signal power (SP) as an integration of the signal energy level over a short period of time. SP is an integration of signal energy over a period of time that in FIG. 1 would involve would involve a plurality of samplings with processing being digital according to the preferred embodiment. In FIG. 1, energy of the speech signal is plotted versus elapsed time for a sample speech signal. This period of time over which the speech signal, which may contain noise, is integrated to obtain power is not the same as the period of the timer initialized in step 400 or as reset in step 406. This period of integration distinguishes the present invention from merely taking and comparing a sample or a plurality of samples of the speech signal, which would involve only comparing amplitude or energy, not power. As mentioned, this integration period is long enough to not be overly affected by a single sample and short enough for rapid response, that is the period of integration is substantial, with the actual value being easily determined from these guidelines in a particular application by one having ordinary skill. Integration is the the embodiment implementation of obtaining power, and numerous equivalent implementations for obtaining the power of a signal are available for use in the present invention, all according to ordinary skill. Operation then returns to step 404.

Step 404 compares the signal power SP with the reference power RP (in comparator control 505). When SP is not greater than RP, processing proceeds to step 409. The speech signal is not transmitted and the transmission portion of the circuit may be turned off to conserve power of the power supply, for example a battery, and the system just receives by passing control to step 409 (switch 506, operated by the output of the comparator control 505, connects the receiver 508 to the use interface 509; thus switch 506 either connects 508 with 509 or connects 507 with 510 for the half-duplex operation; a modification of FIG. 4 and FIG. 5 for full-duplex operation is well within the purview of those having ordinary skill in these arts of the invention).

Step 409 determines if the time period t of the timer has expired (timer and timer control 504). When the time period t of the timer has expired, t=0, operation proceeds to step 402. When the timer has not expired, operation proceeds to step 408 to decrement the timer and move to step 405. The timer is used to continue the transmission of the signal after the detection that SP>Rp has failed, which prevents the transmission of the speech signal from being cut off abruptly. Since the speech signal may become weak, if transmitting were stopped, the users would feel that the speech was cut off. The unexpired timer continues the transmission for the period t if not reset. During the time that SP>RP, the timer will be reset by step 406, and when the timer expires, transmission will stop.

Step 402 calculates a new value for the reference power RP taking into consideration the power of current signal 410 that is now assumed to be only noise because of the expiration of the timer due to the absence of a signal power above the reference level RP throughout an entire period t. From step 402, control passes to step 403 with processing as previously described.

Figure 7:
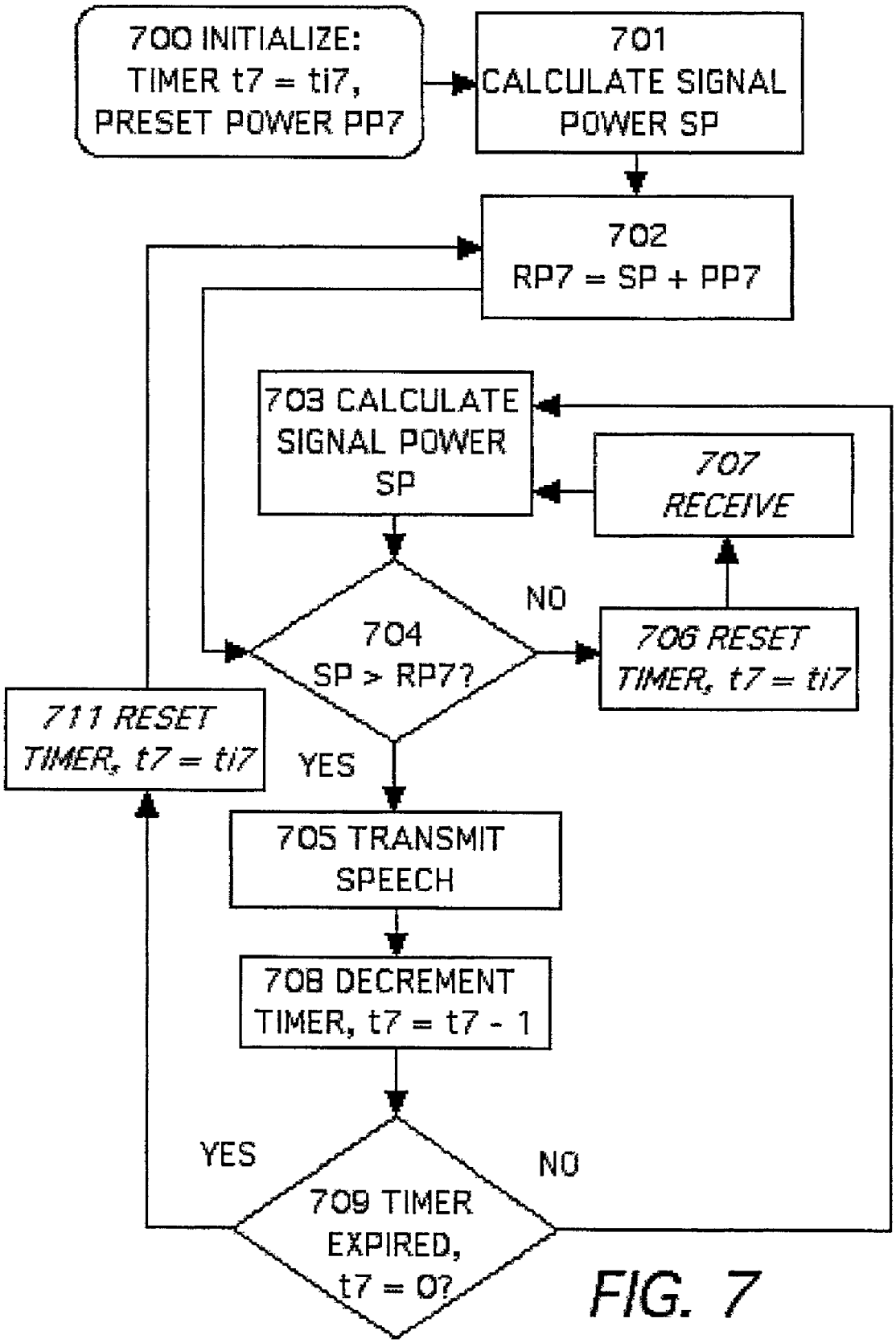
FIG. 7 shows an embodiment that adaptively changes the reference level when noise rises above the current reference level.

FIG. 7 shows an embodiment that adaptively changes the reference level RP when the noise rises above the current reference level RP for the duration of the time period t7. Steps 700–709 and 711, as well as the apparatus and software for implementation, are the same as steps 400–409 and 711, respectively, of FIG. 4, except that the values t7, ti7, and PP7 are preferably different from the values t, ti and PP, and some of the steps are in a different order as indicated in the FIG. 7 to implement the method for adapting to a raised noise level. The speech signal is provided as an input for steps 701 and 703. Steps 706 and 707 follow a decision 704 that SP does not exceed RP& and lead to step 703. Steps 705, 708, and 709 follow a decision of step 704 that SP does exceed RP7. Decision step 709 leads to step 703 when the time period t7 has not expired and leads through step 711 to step 702 when the time period t7 has expired.

Figure 8:
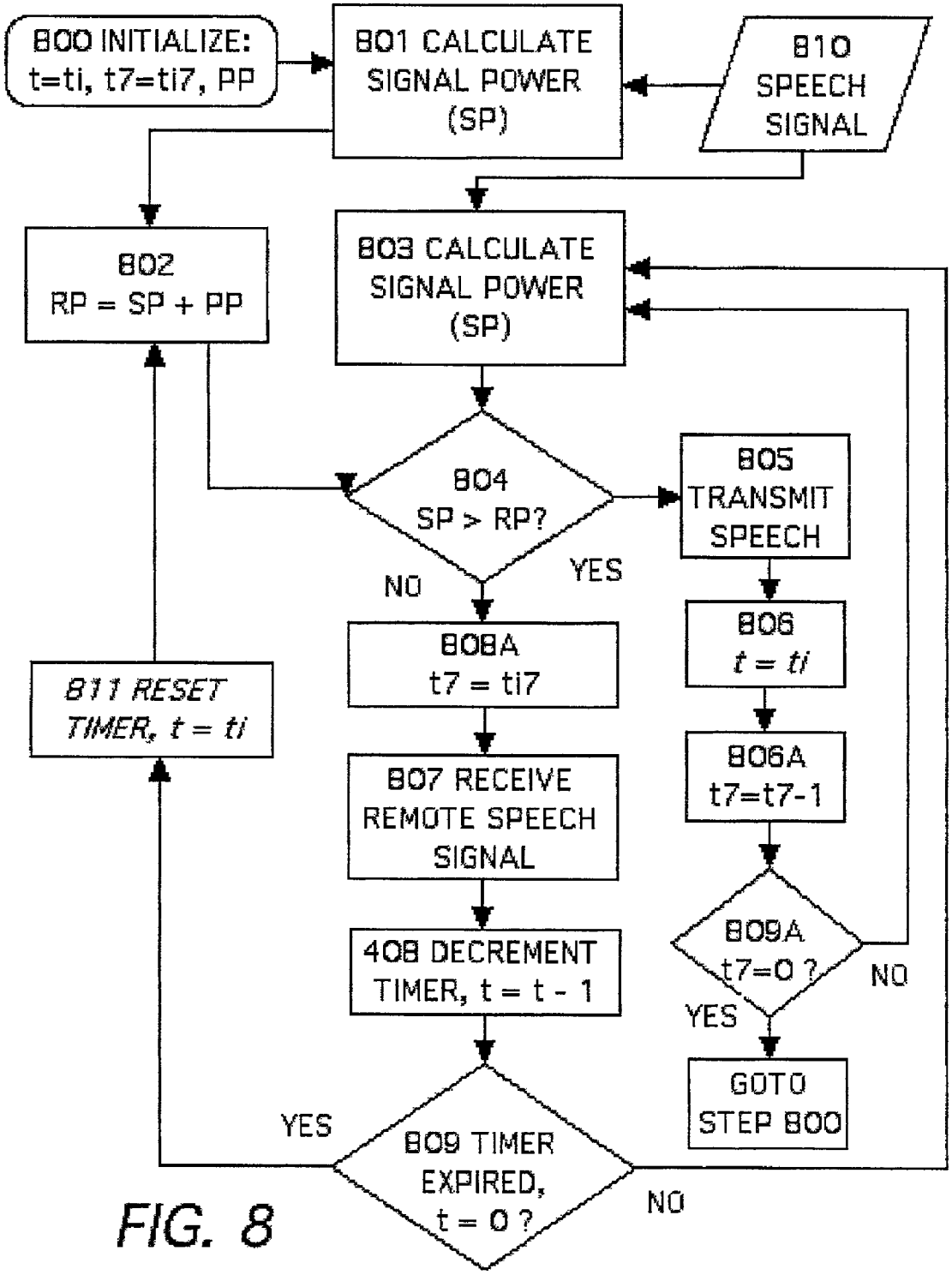
FIG. 8 shows an embodiment that adaptively changes the reference level according to FIG. 7 and according to FIG. 4.

FIG. 8 shows an embodiment that adaptively changes the reference level RP when the noise rises above the current reference level RP for the duration of the time period t7 according to FIG. 7 and that adaptively changes the reference level RP when the noise falls lower the current reference level RP for the duration of the time period t according to FIG. 4. Steps 800–811, as well as the apparatus and software for implementation, are the same as steps 400–410, respectively, of FIG. 4. The steps 806A, 808A and 809A are the same as steps 706, 708 and 709 of FIG. 7 and in the order of FIG. 7.

Figure 9:
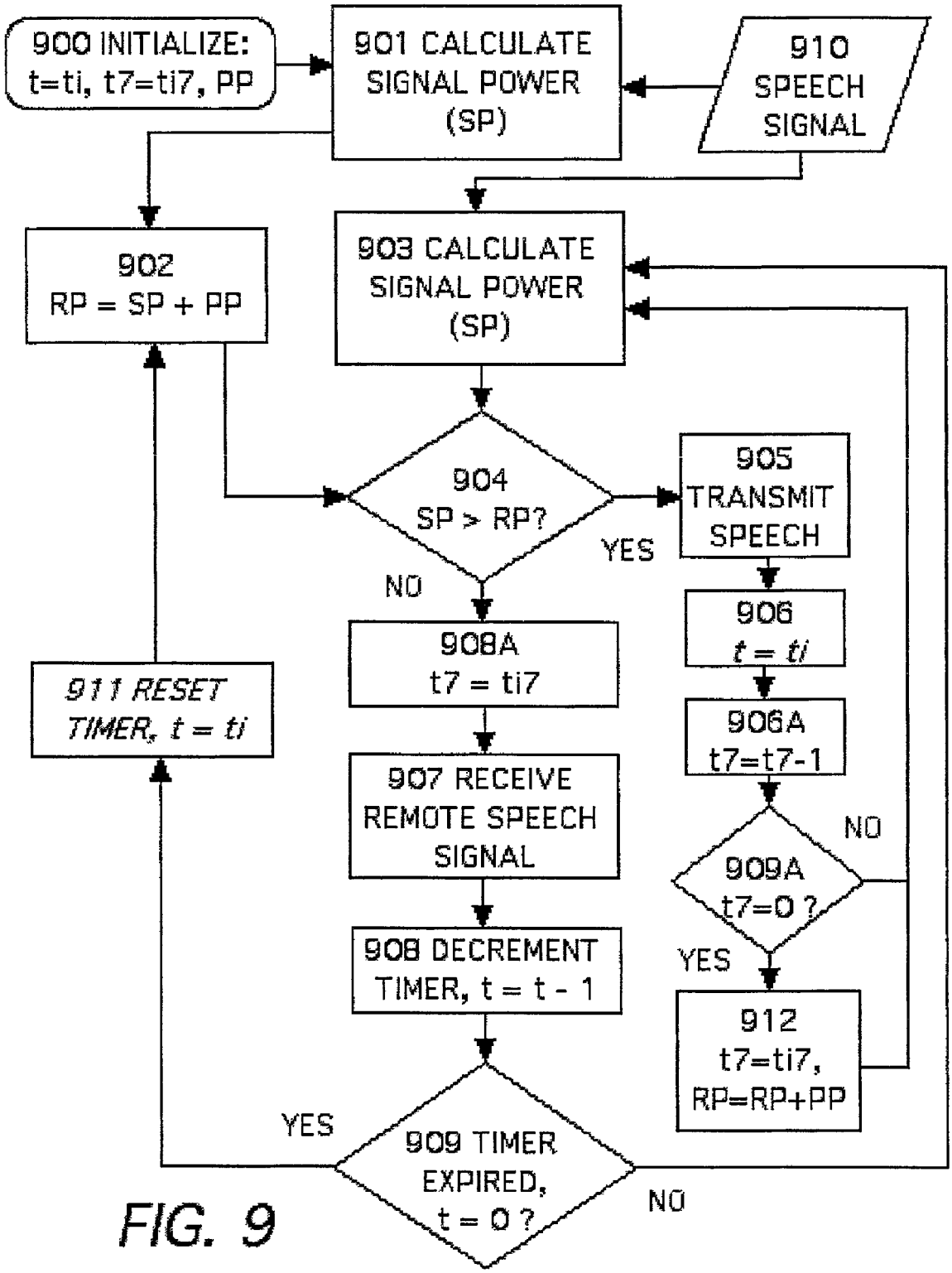
FIG. 9 shows an embodiment similar to FIG. 8.

FIG. 9 shows an embodiment that adaptively changes the reference level RP when the noise rises above the current reference level RP for the duration of the time period t7 and that adaptively changes the reference level RP when the noise falls lower the current reference level RP for the duration of the time period t according to FIG. 8. Steps 900–911, as well as the apparatus and software for implementation, are the same as steps 800–811, respectively, of FIG. 8. The step 912 is added to FIG. 9 to set t7 equal to ti7 and RP equal to RP+PP before returning to step 903, upon a decision by step 909A that t7 equals zero, that is the timer has expired; this is in contrast to FIG. 8 wherein the processing returns to step 900 after a decision by step 909A that t7 equals zero, that is the timer has expired.

Therefore the embodiments simply and efficiently adjust the reference level RP dynamically by using the background noise when no speech has been transmitted for a period of time t involving multiple samplings and comparisons of signal power, so that noise does not affect the performance of VOX devices.

Since VOX will not transmit the speech signal if the signal is less than a preselected level, the reference level is considered to be just above the noise. Thus, noise power (SP when there is no speech) is added to the preselected power level PP, to obtain an updated reference power RP. This dynamically, that is on a real time basis, adjusts the reference power level in dependence upon the current noise power of one sampling period, the integration period. Power over a sampling period produces a far more accurate operation than energy or amplitude at a sampling time. The use of one sampling period is less complex, more accurate and more efficient than the weighted consideration of a plurality of powers from a corresponding plurality of periods as would be the result of using a low pass filter, for example.

With respect to the prior art, it is believed to be impossible to accurately estimate the noise power in a real situation. At the transient, around level C in FIG. 1, noise and speech mix together and would appear to make the perfect detection of the noise impossible. In consideration of this issue, in the present embodiment, the timer 504 is used to control the switch 502 for making the decision at 409 as to whether or not the calculated power SP is noise power.

The inventor determined that speech and noise mix together at the transient period, and the speech signal usually becomes smaller after awhile.

To alleviate the affect of the speech portion of the speech signal 410 from speech input 507, on the estimation of noise power, the embodiment waits a short time by iterations of the loop of steps 403, 404, 409, 408, 405, 406, 403 as controlled by the timer when there is no speech portion of the speech signal. Each iteration is one frame in duration.

The flow of FIG. 4 is applicable both to a loop processing with iterations of a frame and a recursive processing with invocations of a frame duration.

After the timer expires, the operation exits the loop at step 409 and transfers to step 402. Step 402 determines a new reference power RP=SP+PP, which is thereby dynamically determined by including the updated speech power SP from step 401 as an accurately determined noise portion of the speech signal 410 (here estimated noise is substantially equal to the speech signal 410 because the speech signal 410 is considered to have no speech portion due to its absence for the duration of the timer count period t of the timer control 504). Dynamic updating, that is real time updating, of the reference power RP continues by iterations of the loop 402, 403, 404, 409, 402 until step 404 determines that a speech portion is present in the speech signal 410.

When step 404 determines that a speech portion is present in the speech signal 410, the speech portion of the signal 410 will be transmitted by step 405, and the timer reset by step 406. Subsequent iterations of the loop of steps 403, 404, 405, 406, 403 uses the new dynamically updated value of the reference power RP; that is, each of the iterations uses the same value of the reference power RP.

When step 404 determines that a speech portion is NOT present in the speech signal 410 and step 409 determines the time period t of the timer has not expired (timer and timer control 504), operation proceeds to to step 408 to decrement the timer and move to step 405. Thus, the timer is used to continue the transmission of the signal even after the detection that SP>Rp has failed, which prevents the transmission of the speech signal from being cut off abruptly. The unexpired timer continues the transmission for the period t if not reset. During the time that SP>RP, the timer will be reset by step 406, and when the timer expires, transmission will stop.

As mentioned, step 400 initializes the preset power PP and step 402 combines PP with the calculated power SP from step 401 to initially establish the reference power RP, and thereafter iterations or invocations of the remaining steps will reduce RP as the background noise falls or if the background noise starts and remains considerably lower than RP. Now if the background noise increases above the current RP, noise will be transmitted in step 405. If the transmitted noise increases to where it is considered a problem, there are two ways of solving the problem, both involving increasing the value of RP. First, the user could activate a reset, for example with a reset button, and reset the value of RP by forcing process control to step 400. Second, the processing of FIG. 7 could be employed with that of FIG. 4 (also FIG. 7 could be employed without FIG. 4, to automatically raise the reference power as the noise increases and the user, could force a reset to lower the reference power). Third, an additional timer, having a period much longer than the period of either the FIG. 4 timer or the FIG. 7 timing, could be used to return the process to step 400 and/or step 700; for example RP could be initialized every thirty seconds, t of step 406 could be one-half second and t of step 706 could be five seconds.

The timed period t7 of FIGS. 7–9 is preferably larger than the timed period t of FIG. 4. PP in FIG. 7 may be designated as PP7 and be different from the PP of FIG. 4. Corresponding, FIGS. 8 and 9 may have and change both PP and PP7. Preferably, PP7 is much larger than PP, to provide a separation between RP of FIG. 4 for determining falling or low noise and RP7 of FIG. 7 for determining rising or high noise.

FIG. 6 shows the software implemented embodiment of a data communication system in general, and more specifically for VOX. A network 606, which may be a LAN, WAN, satellite links, or internet, couples two like computer stations. Each computer station has, for example: a general purpose computer or application specific processor 600, a monitor 601 and input such as a keyboard 605 to interface the computer/processor with a user, to enter such information as starting the program of FIG. 4 and enter timer and preset power initial and reset values to be used in steps 400 and 406, unless such values are fixed. The monitor may be a desk top type, an LCD display on a hand held device, for example. The storage 602 has the program of FIG. 4 in memory for operation of the general purpose computer 600 or application specific processor as a special purpose machine with components such as those shown in hardware in FIG. 5. Each of the storages 602 may have the same or similar program of FIG. 4, or only one program is in only one storage 602 that may operate both computers 600, for a distributed environment or a local environment or a combination thereof. In operation, the two computers 600 send data (in the embodiment of a VOX such data is speech) to each other through input/output ports and devices (I/O) 603 that may include modems. The data may be analog or digital and as digital data, may represent any information commonly transmitted, including speech. As a VOX system transmitting data representing voice, the user may speak into a microphone (mic) and listen to speech with the headphones of the combination output 604. Various user interfaces may be employed, with a VUI (voice user interface) used in the embodiment to which the invention is particularly adapted.

Various forms of computer-readable media may provide instructions in accordance with FIG. 4 to a processor for execution. Instructions for carrying out at least part of the present invention may be on a magnetic disk 602 of a remote computer 600. The remote computer 600 loads the instructions into its main memory and sends the instructions over a telephone line of the network 606 using a modem 603. A modem 603 of a local computer system, on the other side of the network 606 in FIG. 6, receives the data on the telephone line and uses an infrared transmitter to convert the data to an infrared signal and transmit the infrared signal to a portable computing device 600, such as a personal digital assistance (PDA) and a laptop. An infrared detector on the portable computing device 600 receives the information and instructions of the infrared signal and places the data on a bus. The bus conveys the data to main memory, from which a processor retrieves and executes the instructions. The instructions received by main memory may optionally be stored on a storage device either before or after execution by the processor.

The monitor 601 may be a display, such as a cathode ray tube (CRT), liquid crystal display (LCD), active matrix display, plasma display, or voice user interface with voice command recognition. The input, e.g. keyboard 605, may include cursor control (such as a mouse, a track ball, or cursor direction keys) for communicating direction information and command selections to the processor 600 and for controlling cursor movement on the display 601, or be a voice user interface with voice command recognition.

The communication interface or I/O 603 may be a digital subscriber line (DSL) card or modem, an integrated services digital network (ISDN) card, a cable modem, a telephone modem to provide a data communication connection to a corresponding type of telephone line, a local area network (LAN) card (e.g. Ethernet or Asynchronous Transfer Model (ATM)), wireless devices (such as RF and IR usage devices), or peripheral interface devices (such as a Universal Serial Bus (USB) interface or a PCMCIA (Personal Computer Memory Card International Association) interface).

The network 606 provides data communication through one or more networks to other data devices, for example, a local area network (LAN) to a host computer or a wide area network (WAN) or the global packet data communication network now commonly referred to as the "Internet" or to data equipment operated by a service provider.

Computer-readable medium refers to any data fixing media that participates in providing instructions to the processor 600 for execution, such as non-volatile media (for example, optical or magnetic disks), volatile media (for example DRAM), and transmission media; such further including a floppy disk, a flexible disk, hard disk, magnetic tape, CD-ROM, CDRW, DVD, punch cards, paper tape, optical mark sheets, RAM, PROM, EPROM, FLASH-memory, or any other medium from which a computer can read.

Transmission lines shown as connecting lines in FIG. 5, as lines and network in FIG. 6 and as arrows in FIG. 4, include coaxial cables, copper wire, fiber optics, acoustic waves, optical components, or electromagnetic waves, such as those generated during electronic, optical, radio frequency (RF) and infrared (IR) data communications.

It is seen from the hardware implementation of FIGS. 4 and 5, which may be a part of the computer system of FIG. 6, and the software implementation of FIGS. 4 and 6, together with the method disclosed in FIG. 4 and the computer media implementation, that the present invention is not necessarily limited to any specific combination of hardware circuitry and/or software.

This invention has utility in: hands-free, voice activated communication devices (VOX), such as table top speaker phones, cellular phones, walkie-talkies, VUIs, PDAs, and PHS phones; and data (including voice) activated transmission that is widely used in signal communications, such as in tape or other recorders, and widely used in other controls such as data activated switches for general usage, for example to turn on a light or start a machine.

While the present invention has been described in connection with a number of embodiments, implementations, modifications and variations that have advantages specific to them, the present invention is not necessarily so limited but covers various obvious modifications and equivalent arrangements according to the broader aspects, which fall within the spirit and scope of the following claims.

What is claimed is:

1. A method for managing a transmitter, comprising:

defining a reference level time period;

receiving an input signal including noise and possibly a signal of interest;

calculating a reference level as a function of the power of a first portion of the input signal over the reference time period;

calculating power of a portion of the input signal subsequent to the first portion;

comparing the power of the subsequent portion of the input signal with the reference level;

conducting a transmitter activation determination whether said comparison satisfies a transmitter activation condition, the transmitter activation condition determining whether the power of the subsequent portion of the input signal exceeds the reference level thereby indicating the presence of the signal of interest;

generating an activation signal for activating the transmitter when the transmitter activation condition is satisfied to transmit the signal of interest;

conducting a reference level adjustment determination whether the comparison satisfies a reference level adjustment condition, the reference level adjustment condition testing whether there is a lack of a transition between the presence of the signal of interest in the input signal and the absence of the signal of interest in the input signal for a predetermined time period; and adjusting the reference level when said reference level adjustment condition is satisfied.

2. The method of claim 1, for a voice activated transmission, further comprising:

dividing the input signal into a succession of voice signal frames; and processing the input signal on a frame by frame basis.

3. A computer readable storage media having computer readable code implementing a method for voice activated speech transmission that is dynamically adaptive to a level of noise mixed with valid speech in the input signal, the code including statements for perfonmiing the method of claim 2.

4. A computer readable storage media having computer readable code implementing a method for activation that is dynamically adaptive to a level of noise mixed in the input signal, the code including statements for perfomming the method of claim 2.

5. A computer readable storage media having computer readable code implementing a method for activation that is dynamically adaptive to a level of noise mixed in the input signal, the code including statements for performing the method of claim 1.

* * * * *

UNITED STATES PATENT AND TRADEMARK OFFICE

CERTIFICATE OF CORRECTION

PATENT NO. : 7,146,314 B2
APPLICATION NO. : 10/027934
DATED : December 5, 2006
INVENTOR(S) : Yunbiao Wang It is certified that error appears in the above-identified patent and that said Letters Patent is hereby corrected as shown below:

Column 12
Line 19, change “perfonmiing” to --performing--.
Line 23, change “perfomming” to --performing--.

Signed and Sealed this

Twentieth Day of March, 2007

JON W. DUDAS
*Director of the United States Patent and Trademark Office*